US005293750A

United States Patent [19]

Tamura et al.

[11] Patent Number: 5,293,750

[45] Date of Patent: Mar. 15, 1994

[54] CONTROL SYSTEM FOR LIQUEFIED GAS CONTAINER

[75] Inventors: Itsuro Tamura, Kawachinagano; Tsutomu Takae, Osaka; Yoshiyuki Kawashima, Amagasaki; Kazunori Kawanishi, Osaka, all of Japan

[73] Assignee: Osaka Gas Company Limited, Osaka, Japan

[21] Appl. No.: 799,273

[22] Filed: Nov. 27, 1991

[51] Int. Cl.[5] ..... F17C 5/02

[52] U.S. Cl. ..... 62/47.1; 62/48.1; 62/49.1; 62/50.7; 62/51.1; 62/51.3

[58] Field of Search ..... 62/47.1, 48.1, 49.1, 62/50.7, 51.1, 51.3

[56] References Cited

U.S. PATENT DOCUMENTS

| | | | |
|---|---|---|---|
| 3,307,370 | 3/1967 | Klipping | 62/51.3 X |
| 3,364,687 | 1/1968 | Kolm | 62/51.3 |
| 3,415,077 | 12/1968 | Collins | 62/51.3 X |
| 3,983,714 | 10/1976 | Fletcher et al. | 62/51.3 X |
| 4,689,064 | 8/1987 | Boulanger et al. | 62/47.1 |
| 4,757,261 | 7/1988 | Kneip, Jr. | 62/48.1 X |
| 4,824,454 | 4/1989 | Kondo et al. | 62/47.1 X |
| 4,831,845 | 5/1989 | Oda et al. | 62/51.1 |

FOREIGN PATENT DOCUMENTS

| | | | |
|---|---|---|---|
| 1501291 | 5/1970 | Fed. Rep. of Germany | 62/51.3 |
| 0089054 | 8/1978 | Japan | 62/51.3 |
| 0065857 | 5/1979 | Japan | 62/51.3 |
| 55-004933 | 1/1980 | Japan . | |
| 55-046508 | 4/1980 | Japan . | |
| 0177494 | 11/1982 | Japan | 62/49.1 |
| 0203296 | 11/1983 | Japan | 62/47.1 |
| 0203300 | 11/1983 | Japan | 62/51.3 |
| 61-116250 | 6/1986 | Japan . | |
| 62-77561 | 4/1987 | Japan . | |
| 63-131960 | 6/1988 | Japan . | |
| 63-286670 | 11/1988 | Japan . | |
| 0188800 | 7/1989 | Japan | 62/49.1 |
| 1204482 | 8/1989 | Japan . | |
| 3-50950 | 3/1991 | Japan . | |
| 88/05519 | 7/1988 | World Int. Prop. O. . | |

OTHER PUBLICATIONS

Gamble, T. D., Goubau, W. M., Ketchen, M. B., Clarke, J.; Rev. Sci. Instrum. 49(1) Jan. 1978, pp. 119-120.

Amelin, E. A., Boichuk, V. M., Bondar, A. F., Vakhmenin, A. P., Sosnento, L. P., Instrum. and Exp. Tech. vol. 21, No. 3, p. 2, Oct. 1978.

Journal of Physics E, Scientific Instruments, vol. 1, No. 12, Dec. 1968, Ishing, Bristol, GB; pp. 1253-1254; D. Webster et al.: "A liquid cell cryostat with thermistor feedback control for use with nuclear magnetic resonance spectrometers"; *FIG. 1*.

Advances in Cryogenic Engineering vol. 33 edited by R. W. Fast (pp. 591-597, 879-883).

IEEE Transactions on Magnetics, vol. 25, No. 2, Mar. 1989 (pp. 2560-2562).

IEEE Transactions on Magnetics, vol. 24, No. 2, Mar. 1988 (pp. 1272-1275, 1280-1281).

0020-4412/88/3103-0811$12.50 1988 Plenum Publishing Corporation (pp. 811-813, 1495-1496).

VDI Berichte Nr. 733, 1989 (pp. 301-315).

Cryogenics 1990 vol. 30 Apr. (pp. 365-367).

*Primary Examiner*—Henry A. Bennett

*Assistant Examiner*—C. Kilner

*Attorney, Agent, or Firm*—Wenderoth, Lind & Ponack

[57] ABSTRACT

A control apparatus for maintaining constant the temperature and pressure of the vapor phase in a very low-temperature controlled liquefied gas container includes a pressure sensor, a temperature sensor, two electromagnetic valves, and a refrigerator. When operation of the refrigerator disturbs measurement at low temperature, the refrigerator is stopped. Gas vaporizes from a liquid phase, and gas is discharged from the container. In this manner, the temperature and pressure of the liquefied gas in the container can be maintained constant. After measurement, the liquid level in the container will be lowered by evaporation, so that the liquefied gas is supplied to the container. In this manner, the liquid level in the container can be maintained constant.

4 Claims, 3 Drawing Sheets

HE CYLINDER
17
BUFFER TANK
16
32
GOVERNOR
18
19
V1
V2
PROCESSING
27
21
23
24
25
26
LN2 FEEDER DEVICE
14
13
10a
6
11
12
10
REFRIGERATOR BODY
9
7
7a
4
8
3
2
5
S
1

CONTROL SYSTEM FOR LIQUEFIED GAS CONTAINER

BACKGROUND OF THE INVENTION

1. Field of the Invention

The present invention relates to a control system for a liquefied gas container, such as a low-temperature controlled vessel.

2. Description of the Prior Art

For measuring the extremely weak intensity of magnetic fields arising from organisms, such as a human brain, arm, eyeball, or heart, there has been used a superconductive quantum interference device (hereafter referred to as a SQUID) comprising in combination a superconductive ring and one or two Josephson junctions, which SQUID is immersed in a liquefied helium gas within a low-temperature controlled vessel. There is no known arrangement for controlling the temperature of the liquefied helium gas in such a low-temperature controlled vessel within a precise range of, for example, 4.2°±0.1°K. In order to attain a high precision measurement with a SQUID, it is necessary to maintain the temperature of the liquefied gas at a constant level within close limits.

SUMMARY OF THE INVENTION

The object of the invention is to provide a control system for a liquefied gas container which enables the temperature of the liquefied gas therein to be maintained constant within close limits.

In accordance with the invention there is provided a control system for a liquefied gas container wherein ga within the container in which liquefied gas is stored is condensed by a recondenser of a refrigerator, the control system comprising:

pressure sensing means for sensing the gas pressure in the container, an on-off valve for discharging gas from within the container, a gas source for supplying a gas having the same composition as the liquefied gas stored in the container, a flow control valve for directing the gas from the gas source to a gaseous phase of the container, the flow rate of the gas from the gas source being variable, and control means responsive to an output from the pressure sensing means to open the on-off valve when the gas pressure has become greater than a predetermined positive first value and to open the flow control valve at a predetermined degree of opening for a predetermined period of time when the a predetermined second value.

The control system of the invention further comprises temperature sensing means for sensing or detecting the gas temperature in the container, the control means being responsive to an output from the temperature sensing means to control the refrigerator so that the temperature is maintained equal to a predetermined value.

According to the invention, evaporated gas in a container, such as a low temperature controlled vessel in which liquefied gas is stored, is condensed and reliquefied by a recondenser of a refrigerator. This is done to control the temperature of the liquefied gas. When the refrigerator cannot be operated, during measurement of an extremely weak intensity of magnetic field, the gas pressure in the container is detected by the pressure sensing means, and when the gas pressure is greater than the predetermined positive first value, the on-off valve is opened to discharge gas from the container by, for example, allowing it to be diffused into the atmosphere.

When the refrigerator is operated, the tendency will be for the gas pressure in the container to become negative, and when the absolute value thereof is greater than the predetermined second value, the temperature of the liquefied gas stored in the container may vary largely, and it is very likely that external air or the like will enter the container, with the result that moisture in the air will become condensed within the container and the composition of the container contents will become changed. In order to prevent the occurrence of such condition, therefore, when the negative absolute value of the gas pressure in the container is larger than the predetermined second value, a gas having same composition as the liquefied gas stored in the container is supplied from the gas source into the container through the flow control valve, whereby the negative absolute value of the pressure in the container is changed to the value of the atmospheric pressure level.

The amount of gas to be supplied from the gas source into the container is set to be a value at which the liquid level in the liquid phase of the container is equal to a predetermined level and the gas pressure of the gas phase in the container is equal to a predetermined pressure or, for example, atmospheric pressure. Accordingly, the degree of opening of the flow control valve and the period of time during which the flow control valve is open are preset so that such amount of gas will be supplied. When gas is supplied at a large flow rate in a case where the temperature of the gas being supplied into the container is relatively high, excessive heat is temporarily introduced so that the temperature of the gas phase may be abruptly changed or sudden boiling of the liquefied gas stored in the container may be caused. The opening of the flow control valve is controlled and the gas flow is cooled so as to prevent the occurrence of such condition.

As stated above, according to the invention, gas in the container in which the liquefied gas is stored is condensed and reliquefied by the condenser of the refrigerator. In the case where the condensation capacity of the refrigerator is relatively small or the refrigerator cannot be operated, the gas pressure in the container will rise. When the gas pressure has become greater than the predetermined positive first value, the on-off valve is opened and the gas pressure in the container thus is maintained constant. Conversely, when the refrigerator is operated, the tendency is for the gas pressure in the container to drop to a negative level. When the negative absolute value of the gas pressure is greater than the predetermined second value, a gas having the same composition as the liquefied gas in the container is supplied from the gas source into the container via the flow control valve. The degree of opening of the flow control valve and the time period during which the valve is open are determined so that the liquid level in the liquid phase of the container is equal to the predetermined level and the gas pressure in the gas phase of the container is at the atmospheric pressure level. In this manner, the temperature and pressure of the liquefied gas in the container can be kept constant.

Further, according to the invention, the refrigerator is controlled so that the gas temperature in the gas phase of the container is kept at the predetermined value, whereby the temperature of the liquefied gas can be maintained at a constant level within precise limits.

BRIEF DESCRIPTION OF THE DRAWINGS

Other and further objections, features and advantages of the invention will be made more explicit from the following detailed description taken with reference to the drawings wherein:

FIG. 2 is a flow chart explaining the operation of a processing circuit; an

DETAILED DESCRIPTION OF PREFERRED EMBODIMENTS

Figure 1:
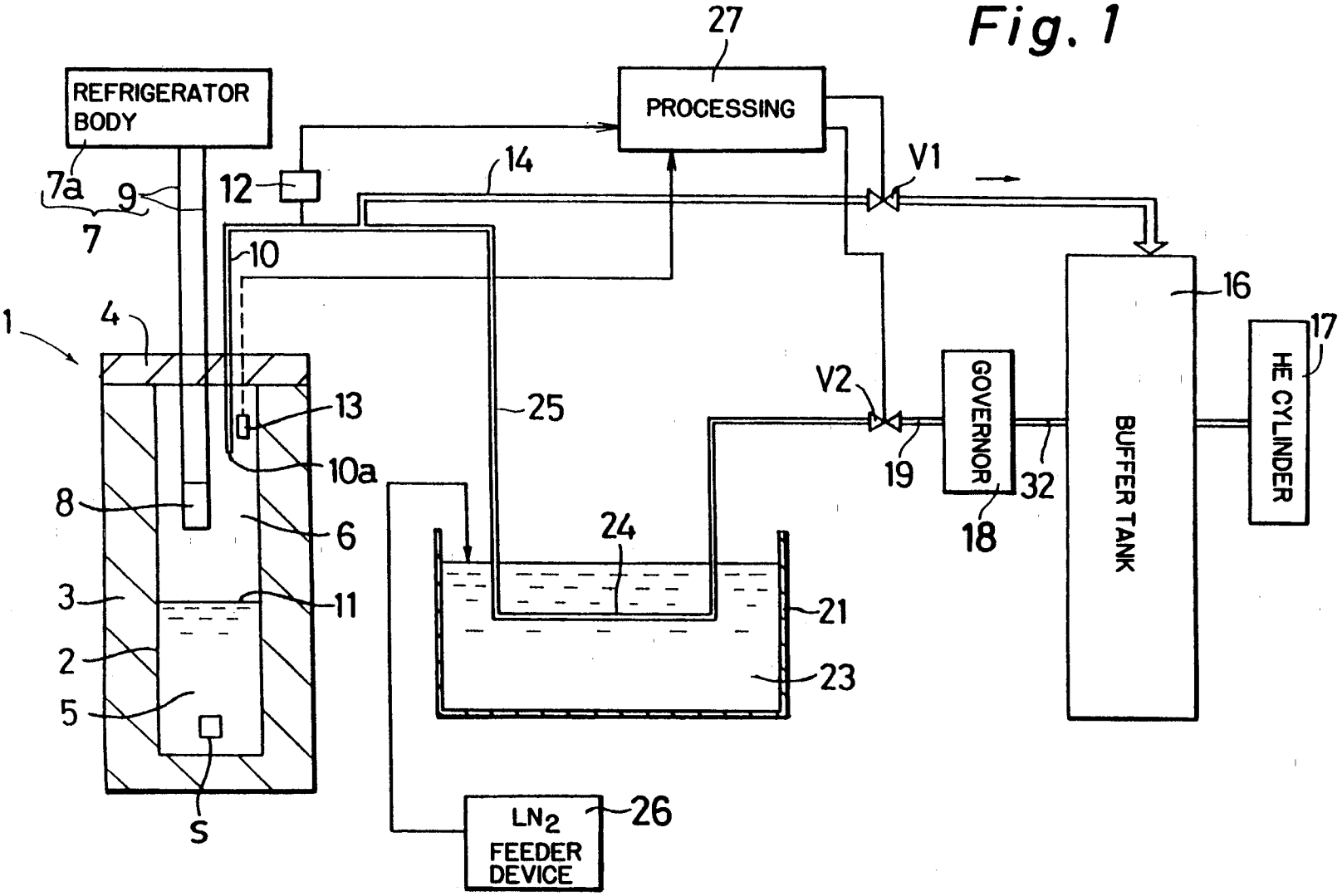
FIG. 1 is a schematic view showing a general arrangement of one embodiment of the invention.

Referring now to the drawings, preferred embodiments of the invention are described below.

FIG. 1 is a schematic view of a general arrangement of one embodiment of the invention. A container 2 in a low temperature controlled vessel 1 is covered with a heat insulating material 3 and is closed by a ceiling plate 4. Liquid helium 5 is stored in the container 2. Immersed in the liquid helium 5 is a superconductive quantum interference devices (SQUID) for measuring the extremely weak intensity of a magnetic field arising from, for example, an organism. In order to measure the extremely weak intensity of the magnetic field to high precision limits by means of the SQUID, it is necessary to maintain the temperature of the liquid helium 5 constant very precisely within the range of, for example, 4.2°±0.1°K. During such measuring however, a refrigerator employed to control the temperature of the liquid helium cannot be operated since such operation would disturb the SQUID. Therefore, the following arrangement is adopted.

Thus, a gaseous helium phase 6 is formed within the container 2 above the liquid helium 5. A recondenser 8, which is a component of the refrigerator, e.g. a compression type refrigerator 7, is disposed in the gas phase 6. A heat medium such as liquid helium flows in the recondenser 8 through transport pipes 9. Helium gas in the gas phase 6 of the container 2 is condensed and reliquefied by the recondenser 8. Disposed outside the container 2 is a main body 7*a* of the refrigerator in which the temperature of the heat medium to be supplied to the recondenser 8 is controlled. Thereby, the temperature of the liquid is controlled when operation of the refrigerator is possible.

Piping 10 is provided in an upper part of the gas phase 6 of the container 2, an end 10*a* of the piping 10 being located above the level 11 of the liquid helium 5 and in the upper part of the gas phase 6. Pressure sensing means 12 is provided in the piping 10 for detecting the gas pressure in the gas phase 6 of the container 2. Temperature sensing means 13 detects the temperature of gas in the gas phase 6 of the container 2. The temperature sensing means 13 is disposed adjacent the end 10*a* of the piping 10 or at some other location in the upper part of the gas phase 6 of the container 2.

The piping 10 is connected to piping 14, with an on-off valve V1 in the form of an electromagnetic valve disposed at a mid-point of the piping 14. Gas from the piping 14 may be discharged via on-off valve V1 by being diffused into the atmosphere, but in this embodiment the gas is collected into a gas source such as a buffer tank 16 at a pressure of, for example, about 100 mm $H_2O$. In a gas supply or pressure vessel 17 is stored compressed helium gas at ordinary temperatures, and such gas is supplied to the buffer tank 16. Helium gas from the buffer tank 16 is supplied to a negative pressure governor 18. The negative pressure governor 18 has a function such that it is opened when the pressure from a secondary pipeline 19 drops to a pressure level of, for example, less than −3 mm $H_2O$, while governor 18 is fully closed when the pressure is higher than such level.

The pipeline 19 has a flow control valve V2 interposed therein. Helium gas flowing through the pipeline 19 and flow control valve V2 is passed through a heat transfer tube 24 submerged in liquid nitrogen 23 stored in a cold tank 21 so that it is cooled down to, for example, 77°K and is then supplied through piping 25 and in turn through piping 10 into the gas phase 6 of the container 2. The cold tank 21 is replenished with liquid nitrogen so that the level of liquid nitrogen 23 is kept constant. A processing circuit 27 which incorporates a computer o the like controls the on-off valve V1 and flow control valve V2 in response to outputs from the pressure sensing means 12 and the temperature sensing means 13.

During measurement of the extremely weak intensity of magnetic fields arising from organisms, the operation of the refrigerator body 7*a*, which would disturb the SQUID, must be stopped. After measuring, the liquid level in the liquid phase of the container is reduced by evaporation of the liquid, so that gas is supplied to the refrigerator. The liquid level in the liquid phase of the container can be maintained at a predetermined level.

Figure 2:
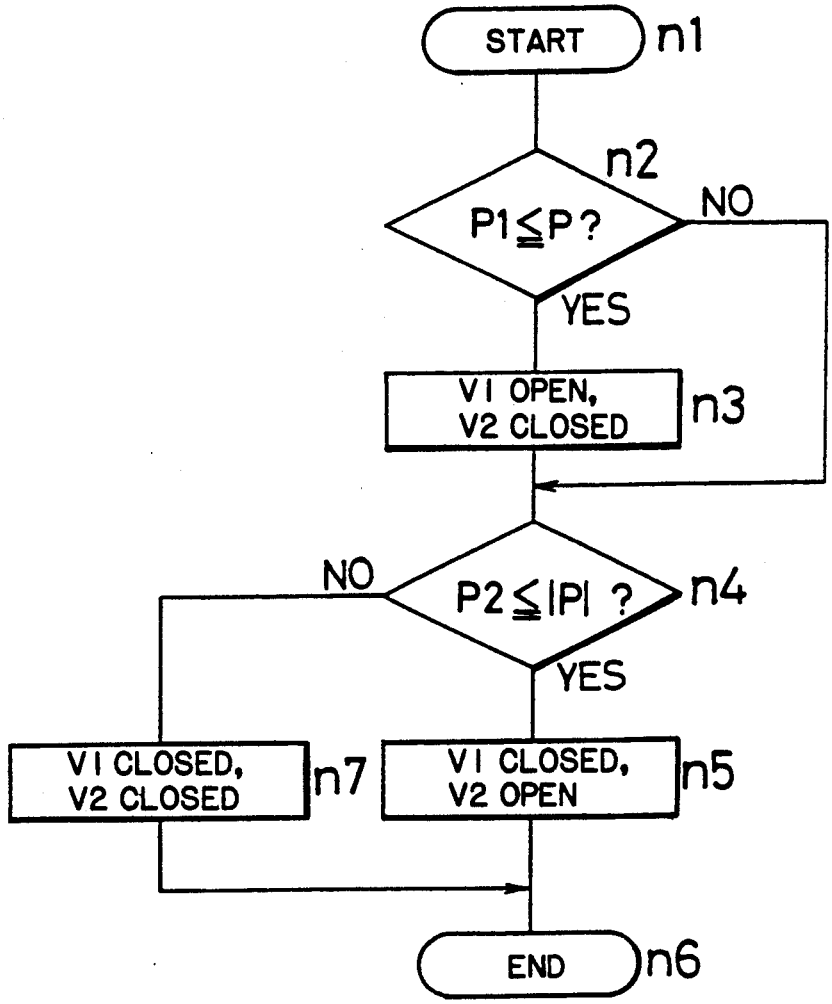

FIG. 2 is a flow chart explanatory of the operation of the processing circuit 27. As earlier stated, the gas phase 6 is provided with a recondenser 8 by which vaporized helium gas is condensed and reliquefied. When the gas pressure P in the gas phase 6 has become higher than a predetermined positive first value P1 which is higher than atmospheric pressure, that is, $$P1 \leqq P \quad (1)$$

then operation proceeds from step n2 to step n3, at which the processing circuit 27 operates to open the on-off valve V1, while the flow control valve V2 remains closed. Accordingly, gas in the gas phase 6 is removed from container 2 and stored in the buffer tank, or in another example it is diffused into the atmosphere. The buffer tank 16 may, for example, take the form of an accumulator or the like.

When the pressure P in the gas phase 6 of the container 2 is lower than atmospheric pressure, or is negative, and the absolute value of the pressure P is greater than a predetermined positive second value P2, that is, $$P2 \leqq |P| \quad (2)$$

$$P \leqq -P2 \quad (2a)$$

the operation proceeds from step n4 to step n5. At step n5, the flow control valve V2 is opened while the on-off valve V1 remains closed. The degree of opening of the flow control valve V2 and the period of time during which it is open are determined such that the amount of gas supplied from the pipeline 10 into the container 2 through the flow control valve V2 coincides with a value at which the pressure in the gas phase 6 is equal to atmospheric pressure. If the flow rate of such supplied gas is excessively large, it is likely that the temperature of the gas phase 6 will fluctuate and, in turn, fluctuations in pressure will result, so that surging or pulsing of the liquid helium 5 may be caused. It is arranged, therefore, that the temperature of the liquid helium 5 will be kept constant so as not to cause such condition.

When pressure P detected by the pressure sensing means 12 is:

$$-P2 \leqq P \leqq P1 \quad (3$$

then operation proceeds from step n4 to step n6, at which the on-off valve V1 is closed and the flow control valve V2 also is closed.

When operation of the refrigerator will not cause disturbance, the processing circuit 27, in response to an output from the temperature sensing means 13, controls the refrigerator body *7a* so that the temperature of the gas phase 6 in the container 2 is kept constant at the predetermined temperature level, whereby the temperature of heat medium supplied to the recondenser 8 is controlled.

The refrigerator 7 may be, for example, a GM (Gifford-McMahon) refrigerator. This type of refrigerator is arranged such that a valve disk driven by a valve motor of an expander is switchable from high pressure to low pressure and vice versa, and a displacer is vertically movable through pressure adjustment by surge volume, whereby a heat medium or helium gas is adiabatic and freely expanded to cool a heat station provided on the displacer. The heat station is equipped with an electric heater so that the temperature of the liquid helium supplied to the recondenser 8 can be controlled by electrically energizing the heater.

The refrigerator 7 however may be of any other suitable arrangement.

Figure 3:
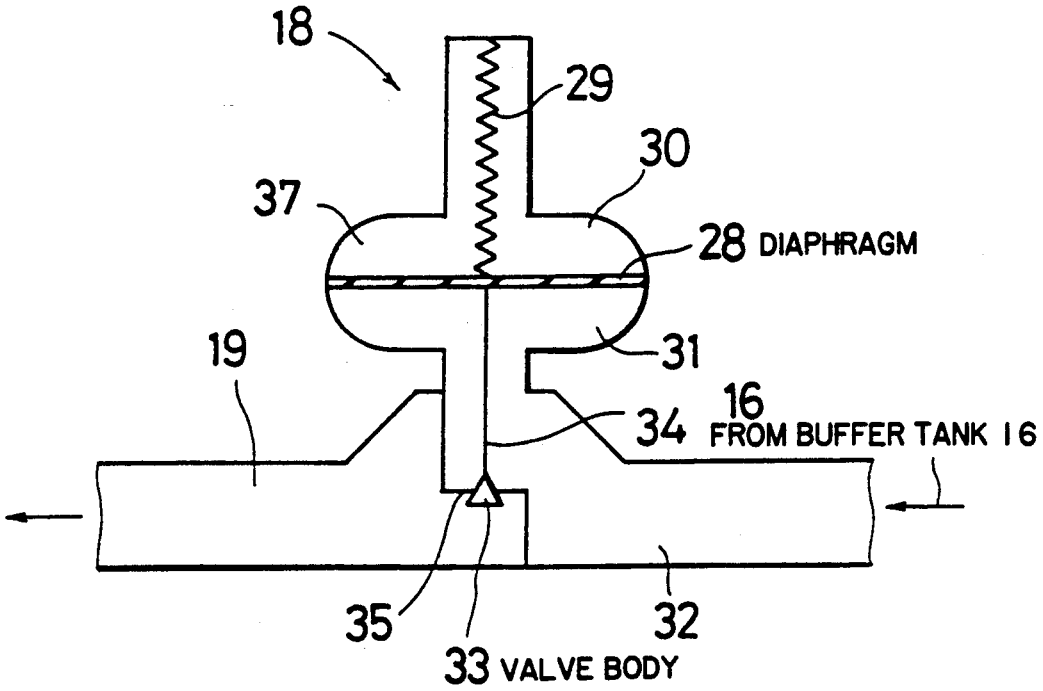
FIG. 3 is a schematic view showing a detailed arrangement of a negative governor and its vicinity.

The arrangement of the negative governor 18 is schematically shown in FIG. 3. In a casing 37 is provided a diaphragm 28 which is elastically pulled upwardly as shown in FIG. 3 by a spring 29. A chamber 30 is open to the atmosphere. A diaphragm chamber 31 is in communication with a pipeline 32 connected to the buffer tank 16. A valve body 33 is coupled by a valve stem 34 to the diaphragm 28 and is adapted to be seated on a valve seat 35. When the pressure downstream in the pipeline 32 is less than $-3$ mm $H_2O$ as stated earlier, the diaphragm 28 is displaced downwardly in FIG. 3 against the spring force of the spring 29, so that the valve body 33 is moved away from the valve seat 35 and opened.

The invention is applicable not only in connection with the use of helium, but also to a wide range of uses in connection with other liquefied gases.

The invention may be embodied in other specific forms without departing from the spirit or essential characteristics of the invention. The present embodiments are therefore to be considered in all aspects as illustrative and not restrictive, the scope of the invention being indicated by the appended claims rather than by the foregoing description, and all changes which come within the meaning and the range of equivalency of the claims are therefore intended to be embraced therein.

What is claimed is:

1. In an assembly including a container containing therein liquefied gas including a gas phase and a liquid phase, a superconductive quantum interference device immersed in the liquid phase and maintained thereby at a precise low temperature enabling said device to be employed to measure weak intensity magnetic fields, and a refrigerator including a recondenser for condensing the gas phase and thereby maintaining said device in the liquid phase at said precise low temperature, whereby it is necessary to stop operation of said refrigeration and said recondenser when said device is being employed to measure a weak intensity magnetic field, during which time the temperature of said device tends to rise above said precise low temperature, the improvement comprising a control system for controlling the gas and liquid phases in said container to ensure that said device is maintained at said precise low temperature in spite of stopping operation of said refrigerator and said recondenser, said system comprising:

pressure sensing means for sensing gas phase pressure in said container;

an on-off valve connected to said container for discharging therefrom the gas phase;

a source of gas of the same composition as the liquefied container in said container;

a flow control valve means between said source and said container for selectively supplying at a controllable flow rate gas from said source to said container; and control means, operably coupled to said pressure sensing means, said on-off valve and said flow control valve means and responsive to an output from said pressure sensing means, for, when the pressure of the gas phase in said container is greater than a predetermined positive first value, opening said on-off valve to thereby discharge gas phase from said container and thus to prevent the temperature of said device from rising above said precise low temperature, and for, when the pressure of the gas phase in said container is negative, relative to atmospheric pressure, and of an absolute value greater than a predetermined second value, opening said flow control valve means by a predetermined degree of opening for a predetermined period of time to thereby supply gas from said source to said container at a controlled flow rate and thus to prevent the temperature of said device from dropping below said precise low temperature.

2. The improvement claimed in claim 1, further comprising a pipeline for conveying gas from said source through said flow control valve means to said container, and a gas cooler for cooling gas in said pipeline prior to introduction thereof into said container.

3. The improvement claimed in claim 1, further comprising a governor positioned upstream of said flow control valve means and operable in response to a negative pressure of said gas phase in said container to control the rate of flow of gas from said source through said flow control valve means to said container.

4. The improvement claimed in claim 1, wherein said source comprises a buffer tank connected to said flow control valve, said on-off valve being connected to said buffer to supply thereto gas phase discharged from said container upon opening of said on-off valve by said control means, and a gas supply connected to said buffer tank for replenishing gas therein when the quantity of gas therein decreases below an amount required to supply gas to said container upon said flow control valve means being opening by said control means.

* * * * *